US006681801B2

(12) United States Patent
Hoehn et al.

(10) Patent No.: US 6,681,801 B2
(45) Date of Patent: Jan. 27, 2004

(54) PUMPING STATION WITH EFFICIENCY INCREASING AND BACKFLOW PREVENTING STRUCTURE

(75) Inventors: Wolfgang Hoehn, Lambsheim (DE); Hans-Dieter Knoepfel, Frankenthal (DE); Gerhard Meyer, Frankenthal (DE); Wolfgang Roesler, Mannheim (DE); Hartmut Rosenberger, Neustadt/Weinstrasse (DE)

(73) Assignee: KSB Aktiengesellschaft, Frankenthal (DE)

( * ) Notice: Subject to any disclaimer, the term of this patent is extended or adjusted under 35 U.S.C. 154(b) by 0 days.

(21) Appl. No.: 10/341,596

(22) Filed: Jan. 14, 2003

(65) Prior Publication Data

US 2003/0152470 A1 Aug. 14, 2003

Related U.S. Application Data

(63) Continuation of application No. PCT/EP01/07923, filed on Jul. 10, 2001.

(30) Foreign Application Priority Data

Jul. 14, 2000 (DE) ..... 100 34 174

(51) Int. Cl.[7] ..... E03B 11/00

(52) U.S. Cl. ..... 137/565.17; 137/565.23; 137/565.33; 137/573; 137/574; 137/576; 52/21

(58) Field of Search ..... 137/565.17, 363, 137/372, 573, 574, 576, 565.23, 565.33; 52/21

(56) References Cited

U.S. PATENT DOCUMENTS

| | | | | | |
|---|---|---|---|---|---|
| 1,148,500 | A | * | 8/1915 | Caverno | 137/565.17 |
| 1,964,034 | A | * | 6/1934 | Cook | 137/565.17 |
| 3,149,472 | A | * | 9/1964 | McCall et al. | 137/565.17 |
| 3,461,803 | A | * | 8/1969 | Stothoff | 137/565.17 |
| 4,049,013 | A | * | 9/1977 | Shenk | 137/263 |
| 4,576,197 | A | * | 3/1986 | Kempers | 137/573 |

FOREIGN PATENT DOCUMENTS

| | | |
|---|---|---|
| DE | 0659106 | 4/1938 |
| EP | 0118403 | 2/1984 |
| FR | 1350608 | 4/1964 |
| GB | 1070259 A | 6/1967 |
| GB | 2027470 A | 2/1980 |
| JP | 55153899 | 12/1980 |
| JP | 58172490 | 10/1983 |
| JP | 09-112436 | 5/1997 |
| JP | 09-177165 | 7/1997 |

OTHER PUBLICATIONS

Goerke et al., "Gestaltung von Schoepfwerken" ("Design of Water Intake Installations"), KSB Technische Berichte 11, (1966) pp. 28–36.

International Search Report dated Nov. 27, 2001.

* cited by examiner

*Primary Examiner*—A. Michael Chambers
(74) *Attorney, Agent, or Firm*—Crowell & Moring LLP

(57) ABSTRACT

A pump station including a structure that includes at least one inlet chamber and at least one discharge chamber arranged on a different level. A separating wall is arranged within the structure between the two chambers, and at least one pump delivers a liquid from the inlet chamber through the separating wall into the discharge chamber. The discharge chamber includes a discharge opening having an upper edge which is below the liquid level that is present in a discharge downstream of the discharge chamber. The pump is provided with an upwardly extending liquid conveying device which ends in an open outlet that opens into the discharge chamber above the upper edge of the discharge opening.

17 Claims, 5 Drawing Sheets

PUMPING STATION WITH EFFICIENCY INCREASING AND BACKFLOW PREVENTING STRUCTURE

CROSS REFERENCE TO RELATED APPLICATIONS

This application is a continuation of international patent application no. PCT/EP01/07923, filed Jul. 10, 2001, designating the United States of America and published in German as WO 02/06596, the entire disclosure of which is incorporated herein by reference. Priority is claimed based on Federal Republic of Germany patent application no. DE 100 34 174.8, filed Jul. 14, 2000.

BACKGROUND OF THE INVENTION

The present invention relates to a pumping station comprising a structure which has at least one inlet chamber and at least one discharge chamber which is arranged at a different height, a partition arranged within the structure between these at least two chambers, at least one pump delivering a liquid through the partition into a discharge chamber of the structure, the discharge chamber having a discharge opening which is arranged at an angle to an outlet opening, wherein the upper edge of the discharge opening is situated below a liquid level which prevails in a discharge arranged downstream of the structure.

Pumping stations, which are also referred to as water intake installations, dike or discharging intake installations, water lifting installations, irrigation pumping installations or under similar terms, have to deliver large amounts of water with small delivery heads. A general overview of systems of this type is disclosed by the essay entitled "Gestaltung von Schöpfwerken [Design of water intake installations]", by Helmut Göhrke and Paul Winkelmann, published in KSB Technical Reports No. 11, August 1966, pages 28–36. With changing levels on the inlet side and with fluctuations in the external water levels arranged downstream of the pumping station, pumping stations have to cope with different delivery heads. Since the pumps which are in use, which are essentially of axial or semiaxial design, discharge only relatively small delivery heads, the slight fluctuations in the delivery head, which fluctuations are required for efficient operation of the system, are a problem for the design of pumping stations of this type.

In order to keep the costs of a structure of this type low, vertical impeller pumps are predominantly used. For small delivery heads of up to approximately 2 meters the above-mentioned essay has disclosed the use of what is referred to as an open impeller pump. In this case, a liquid which is to be delivered, after having passed the impeller, flows directly out of the pump housing, which is designed to be open on the delivery side, into the discharge chamber of the pumping station. As in the case of all pumping stations having the aforementioned intended use, a back flow preventing mechanism has to be arranged on the delivery side of the pump and is used, when the pump is switched off, to prevent backflows of liquid which has already been delivered. For this purpose, in known pumping stations, the discharge opening of the discharge chamber is fitted with a positively controlled non-return flap which serves simultaneously as back flow preventer and a shut-off element, cf. page 31, FIG. 3A.

SUMMARY OF THE INVENTION

It is an object of the invention to provide a pumping station which ensures reliable and energy efficient operation.

A further object of the invention is to provide a pumping station which can be constructed with comparatively low expenditures for equipment and structure.

These and other objects are achieved in accordance with the present invention by providing a pumping station comprising a structure which includes at least one inlet chamber and at least one discharge chamber for a liquid which is to be conveyed, the discharge chamber being arranged at a different height from the inlet chamber, a separating wall within the structure between the inlet and discharge chambers, and at least one pump for delivering a liquid through the separating wall into the discharge chamber, the discharge chamber having a discharge opening which is arranged at an angle to an open outlet opening of the pump, the discharge opening having an upper edge situated below a liquid level which prevails in a discharge arranged downstream of the structure, wherein the pump is provided with an upwardly directed, liquid-conducting device leading to the pump outlet opening, and the outlet opening is arranged in the discharge chamber above the upper edge of the discharge opening.

In the present invention, each pump is provided with a liquid-conducting device which extends in an upward direction and has an open outlet opening which is arranged in the discharge chamber above the upper edge of the discharge opening.

This solution means that an additional installation of a shut-off flap can be omitted. And, the device which conducts liquid in an upward direction can be a pipe, channel, a tube or a similar construction designed as part of the structure. The saving which is possible as a result on a hitherto necessary shut-off flap increases the operational reliability considerably with a simultaneous reduction in the investment costs. This is because shut-off flaps of this type constitute a maintenance-intensive and fault-prone component as a consequence of the control necessary for their operation and the moving components which are frequently underwater.

One refinement of the invention makes provision for the upper edge of the discharge opening to be part of an adjustable opening. Therefore, in the development of a standardized structure for a pumping station, adaptation of the structure to the respective maximum and minimum levels on the discharge side of the pumping station can take place in a very simple manner by means of a simple matching of the upper edge of the discharge opening to the height of the outlet opening, which is designed to be open, of the liquid-conducting device. In the planning or production of the pumping station, adaptation to the predetermined levels of the inlet and discharge channels situated outside the structure can take place by simply varying a framework defining the upper edge of the discharge opening. The upper edge may also be part of a height-adjustable device or of a device which can be adjusted during operation.

Another refinement of the invention makes provision for a delivered flow measuring device to be arranged in the liquid-conducting device and/or in the region of the discharge opening. Also, according to a further refinement of the invention, a discharge channel, a pipe or the like, running predominantly horizontally and having a delivered flow measuring device arranged in it can be arranged downstream of the discharge opening. A delivered flow measuring device of this type enables a pump station to be monitored in a very simple manner to such an extent that it can even be remotely diagnosed and/or remotely maintained. With the aid of a delivered flow signal, which can be transmitted in various known ways, it is possible to ascertain whether the pumping station is operating correctly.

In order to reduce the cost of measuring devices for measuring the delivered flow, provision is made for a cross section which is used for measuring the delivered flow and through which the flow passes or a volume region through which the flow passes to be completely filled with the delivered liquid. For this purpose, a highest point of a measured-value detection region of this type, which is generally arranged in part of the flow path on the delivery side, lies below the lowest water level on the discharge side. The continuous and complete filling of such a measuring section can be achieved by means of its local lower positioning or by means of an overflow threshold arranged at the end thereof. The cross section which is used for the measuring and through which the flow passes should always be below the lowest level on the discharge side on which a design of a pumping station of this type is based. The arrangement of a type of overflow threshold at the end of a measured section of this type enables the structural outlay in the case of excavation works to be reduced. Fluctuations in the height on the discharge side are therefore unable to affect the liquid level in the measurement section. The same effect can be achieved with a measurement section on the discharge side, which is designed in the manner of a sump. Section guidance of this type, which makes use of the principle of communicating tubes, ensures complete filling of liquid in the pipe, the tube, the channel or the like which is used for measuring the delivered flow.

According to another refinement of the invention, a pump is fitted with fixed and/or adjustable running and/or conducting devices. The use of adjusting devices of this type is dependent on the operating conditions which are used for the pumping station. Although the use of pump designs of this type in a pumping station increases the investment costs, they bring about an improvement in the efficiency compared to what are referred to as rigid, i.e. nonadjustable pumps. This also brings about a considerable reduction in the power costs, as a result of which a system of this type can be operated more cost-effectively, as considered over a prolonged operating period. The saving on the costs of energy reduces the costs of the lifecycle of the system for the operator.

According to another refinement of the invention, the device conducting the liquid in an upward direction runs vertically or inclined, in which case the outlet opening is arranged parallel or inclined with respect to the liquid level. If the spatial constructions of the discharge chamber require a different arrangement or position of the outlet opening for flow engineering and/or location-specific reasons, then the surface of the outlet opening can also run at an angle and/or inclined with respect to the horizontal. In this case, as in the case of an outlet opening running horizontally, it merely has to be ensured that a lowermost edge of the outlet opening is always situated above the highest liquid level taken as a basis on the discharge side in the planning of the pumping station. When a pump is switched off, this measure prevents liquid which has already been delivered from flowing back into the inlet chamber via the outlet opening and through the pump.

The outlet opening, or the lowest edge thereof, is always situated, even if only slightly, above the maximum liquid level which occurs. This also gives rise to a further substantial advantage in that the siphon effect, which is known per se, can be used for a pumping station of this type. The construction of the pumping station in terms of structure can therefore be directly designed as a siphon without the hitherto known, special siphon pipes additionally having to be installed. In this case, the outlet opening of the liquid-conducting device which is arranged downstream of a pump forms the lower apex of the siphon. The design of the discharge chamber as a siphon is directly associated with the energy-saving potential of the pumping station through recovery of the geodetic difference in height between the lower apex of the siphon and the level on the discharge side. This is ensured by the position of the upper edge of the discharge opening at the height of the lowest level on the discharge side.

When the pump is switched off the discharge chamber of the pumping station is ventilated with the aid of a valve causing the siphon effect to be cancelled. It is possible to construct the discharge chamber air and liquid tight without difficulty during erection of the structure, since the chamber can be designed in a cost-effective manner as a concrete construction. In order to improve the sealing effect in the discharge chamber, coatings which provide a seal in an appropriate manner can be applied in a simple manner to the wall surfaces of the discharge chamber. A pumping station constructed in this way enables the hitherto used, long siphon pipes to be omitted. Due to the low reflux quantities in this solution, the cost of measures to secure the pump against backflows can be entirely avoided or, under some circumstances, maintained at a very low level.

In order to enable starting up even in special cases with an increased power consumption in the partial-load region of the pump, a vacuum system for eliminating air from the discharge chamber may additionally be provided. The vacuum system would then operate only during the starting-up process of the pump. Depending on the design of the pumping station and the operating conditions thereof it would have to be decided whether preference is given, for example, to a more powerful drive motor for the pump or to a vacuum system.

In this respect, a further refinement of the invention makes provision for a drive unit of a pump of a design without a shaft seal to be arranged above the discharge chamber. The drive unit, for example an electric motor or internal combustion engine, with or without a gear mechanism connected in between, is arranged here at a height which lies above the highest level which occurs with respect to the pumping station. The discharge chamber would be connected here to the surroundings. The dynamic pressure components of the flow which exist in the liquid-conducting device and are produced by the pump are not sufficient to bridge the height and reach as far as the drive unit.

If the discharge chamber is sealed and forms part of a siphon, sealing with respect to a drive unit which is mounted outside the discharge chamber is undertaken with known means. In pump designs where a drive is set up to be dry, a drive shaft has to be extended into the discharge chamber. In this case, a dynamically acting shaft seal can be saved on by means of a shaft protective tube which surrounds the drive shaft and is connected in a fixed and leakproof manner to the discharge chamber. One open end of the tube projects into the discharge chamber and the length of the tube is selected such that a backing-up pressure is formed therein on account of the flowing delivered liquid. This backing-up pressure, in association with the rise in pressure caused by the flow losses in the discharge chamber, which is connected downstream of the outlet opening, and discharge devices connected in turn downstream of the discharge chamber, prevents air from the surrounding environment from entering the discharge chamber and the liquid-conducting device. One can therefore save on a shaft seal for the pump shaft, since a liquid level arises in the shaft protective tube and because of the liquid level air would not be able to enter the discharge chamber from the outside and have an adverse effect on its siphon effect. In those cases in which distenable hydraulic equipment is used, the shaft protective tube can also be used for suspending the hydraulic unit from the pump.

Also, in order to prevent backflows of the delivered liquid when the pump is switched off, the discharge chamber can be provided with a venting device. A valve which is used for this purpose and is situated with associated connecting pipes in that region of the pumping station which is arranged such that it is dry is easily accessible, is of small overall height, can be actuated in a very simple manner and, when required, interrupts the siphon effect.

BRIEF DESCRIPTION OF THE DRAWINGS

The invention will be described in further detail hereinafter with reference to illustrative preferred embodiments shown in the accompanying drawings in which.

DETAILED DESCRIPTION OF PREFERRED EMBODIMENTS

Figure 1:
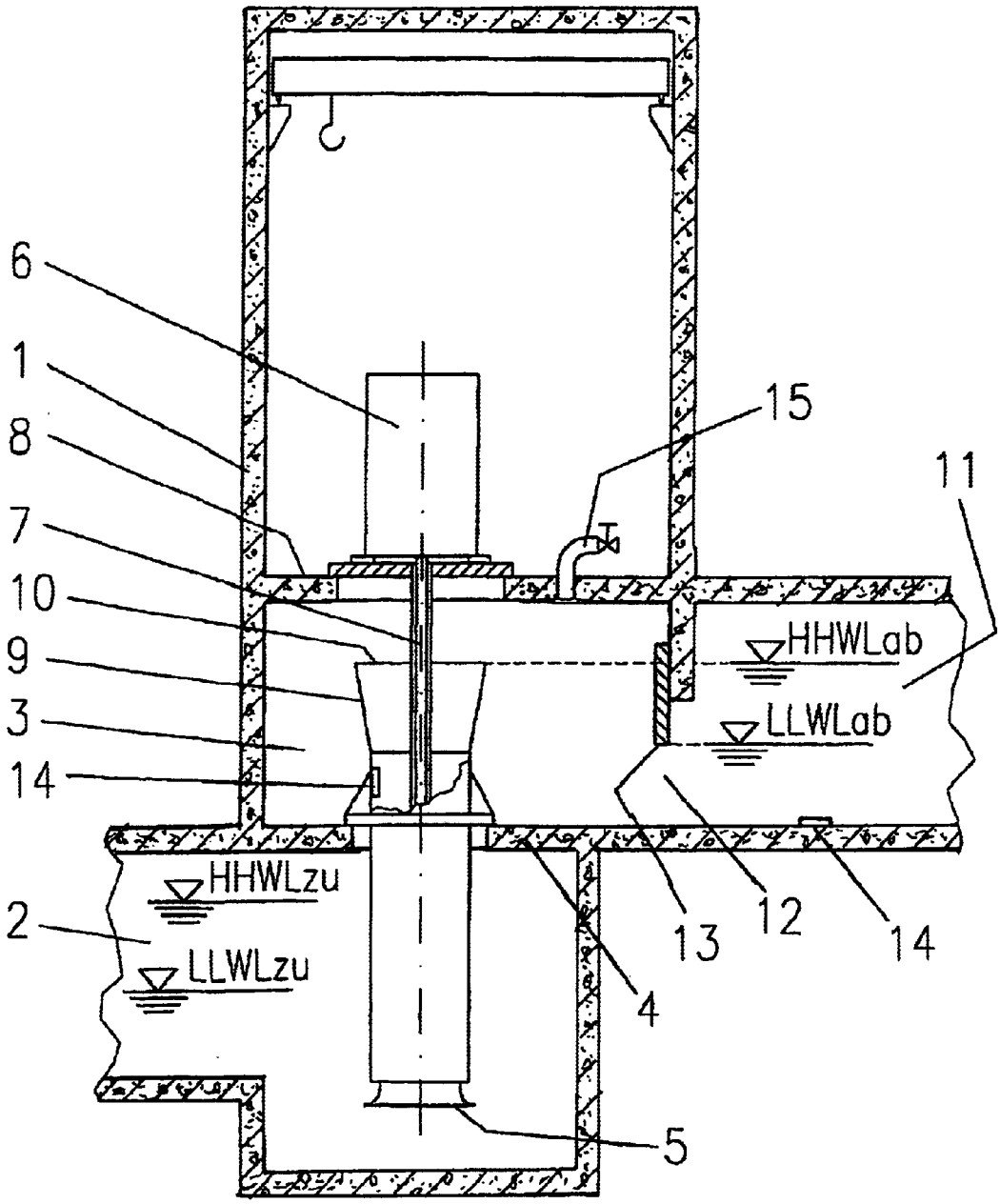
FIG. 1 is a schematic illustration of a pumping station having a simple design.

FIG. 1 shows a pumping station 1 which has an inlet chamber 2 and a discharge chamber 3. Within the inlet chamber 2, which can be designed to be open or covered and in which a liquid which is to be delivered flows in from an external source, two levels of the liquid to be delivered are shown. LLWLin stands here for the lowest low water level and HHWLin stands here for the highest high water level which can occur on the inlet side of this pumping station 1.

A partition 4 through which a pump 5 extends in a vertical arrangement is arranged on the upper side of the inlet chamber 2. One or more impellers are arranged in the lower part of the pump 5. A drive unit 6 arranged above the pump 5 brings about the drive of the pump 5. The transmission of power between the drive unit 6 and pump 5 takes place by means of a shaft 7. The drive unit 6 rests by customary fastening means on the cover 8 of the discharge chamber 3. In the example shown, the drive unit 6 is fastened on the cover 8 in an air-tight manner, so that the discharge chamber 3 itself exerts a siphon effect.

The housing of the vertically arranged pump 5 is designed as a liquid-conducting device 9 which has an outlet opening 10 which is designed to be open and extends parallel to the liquid level. The outlet opening 10 lies at a height which is at least level with or lies above the highest high water level HHWLout on the side of the pumping station 1 having the discharge 11. The liquid-conducting device 9, which is designed here as an upward tube, opens with the open tube end or the outlet opening 10 into the closed discharge chamber 3, which is designed to be liquid-tight with respect to the inlet chamber 2. The discharge chamber 3 has a discharge opening 12 through which a connection is produced with the discharge 11 which is arranged downstream of the pumping station 1. Two levels are likewise shown in the discharge 11. The level LLWLout marks the lowest low water level here and the level HHWLout marks the highest attainable level on the discharge side.

The upper edge 13 of the discharge opening 12 from the discharge chamber 3 lies here at maximum at the level of the lowest level LLWLout. The outlet opening 10 of the liquid-conducting device 9 is situated at least at the height of the highest high water level HHWLout on the discharge side 11. The pump 5 therefore only has to produce at most the same delivery power as is necessary at the simultaneously lowest LLWLin in the inlet chamber in order to achieve the highest water level HHWLout.

The upper edge 13 of the discharge opening 12 is part of an adjustable opening. Adaptation of the structure to the respective maximum and minimum levels HHWLout and LLWLout on the discharge side 11 of the pumping station 1 takes place in a very simple manner by simple matching of the upper edge 13 of the discharge opening 12 to the height of the outlet opening 10, which is designed to be open, of the liquid-conducting device 9. Adaptation to the predetermined levels of the inlet and discharge channels situated outside the structure takes place by simply varying the upper edge. The upper edge is illustrated here as part of a height-adjustable device. It can be secured fast in the discharge chamber by customary fasteners. In the event of sharply fluctuating levels on the side having the discharge 11, it is a matter of calculation as to whether, for reasons of energy saving, the upper edge 13 is designed as a device which can be adjusted during operation.

Sensors 14 of flow-measuring instruments can be arranged within the liquid-conducting device 9, in the region of the discharge opening 12 or in the discharge 11.

In order, when the pump 5 is switched off, to prevent a backflow of the delivered liquid from the side having the discharge 11, the discharge chamber 3 has a venting device 15. In the illustrated embodiment, this venting device comprises a pipe having a ventilation valve arranged on it. If a ventilation valve of this type is opened, then the drawing force of a falling column of liquid in the discharge chamber 3, which is designed as a siphon, is interrupted by the introduction of air.

Figure 2:
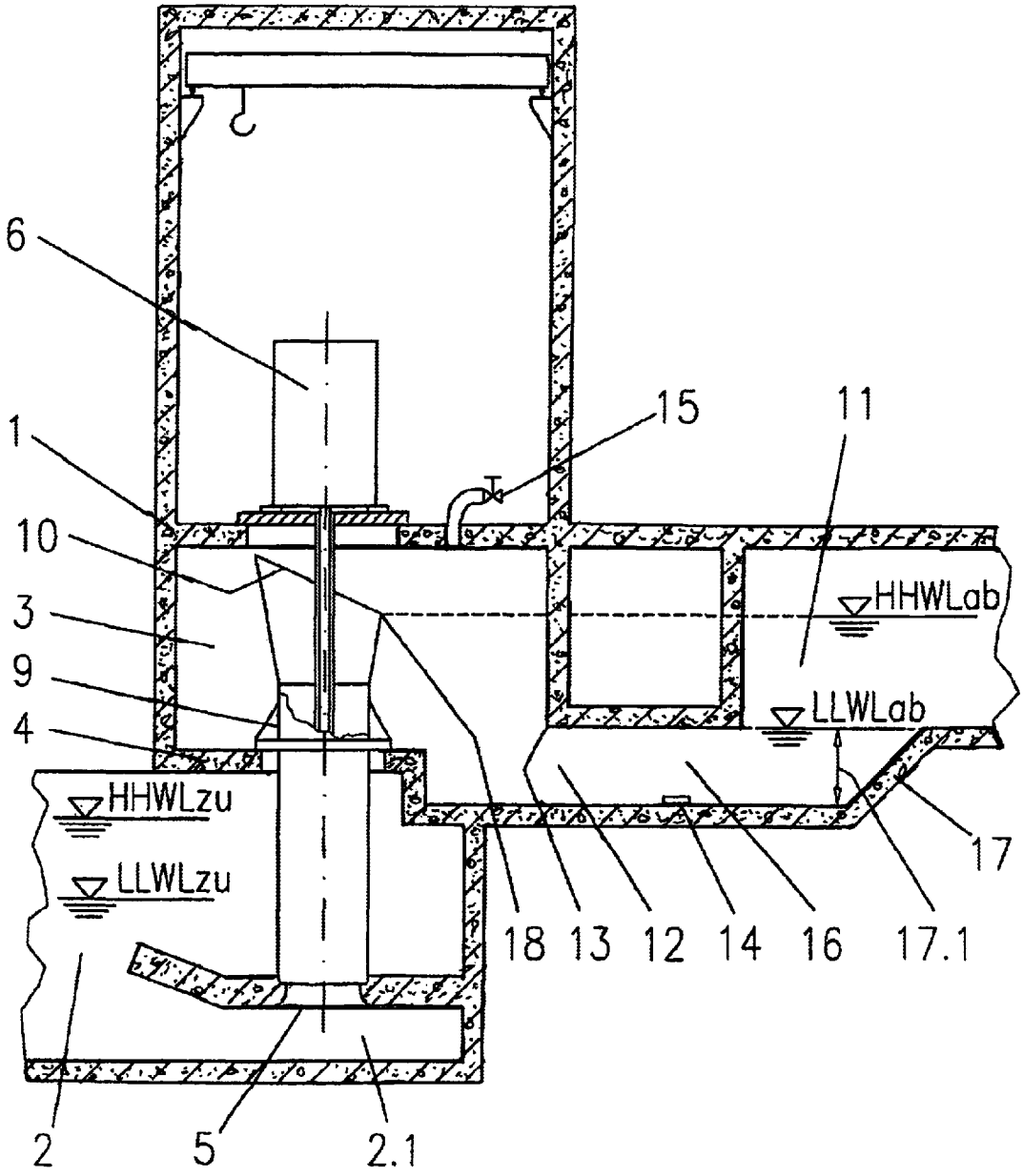
FIGS. 2 and 3 depict pumping stations having an integrated measurement channel.

FIG. 2 shows a pumping station 1 in which a measuring channel 16 is arranged downstream of the discharge opening 12 of the discharge chamber 3. In this measuring channel 16, the highest point is situated at maximum at the level of the lowest low water level LLWLout. The complete filling of the measuring channel 16 with liquid is therefore ensured, as a result of which simple delivered flow measuring instruments, for example ultrasound sensors 14, can be used for measuring the delivered flow. Air locks which falsify a measurement are avoided as a result. In order to ensure the continuous filling of the measuring channel, an overflow threshold 17 can be arranged in the discharge 11 of the pumping station 1. The height 17.1 of the overflow threshold is dimensioned in such a manner that a minimum water level LLWLout in the measuring channel 16 remains ensured in all operating states. In principle, a measuring channel 16 designed in such a manner is formed as a sump. The pumping station shown in FIG. 2 to such an extent illustrates a combination of pump with siphon arranged downstream and sump arranged downstream of the siphon.

Since, in this illustrative embodiment of a pumping station of this type, the discharge chamber 3 is of smaller design, preference would be given, on account of the structural circumstances, to an upward tube 9 having an obliquely extending outlet opening 10. The lower edge 18 of the open outlet opening 10 is always level with or slightly above the highest high water level HHWLout on the side having the discharge 11.

Figure 3:
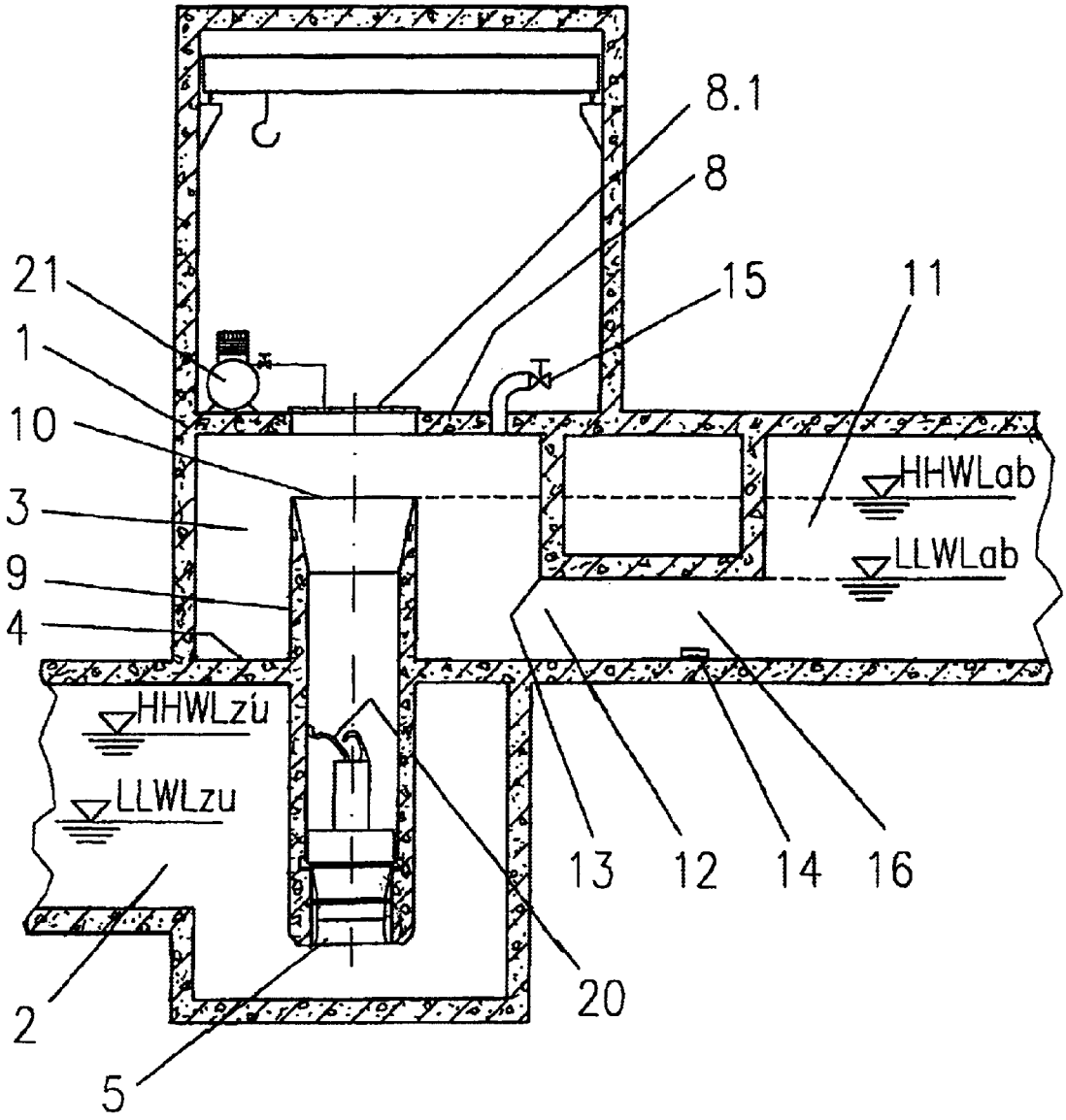

In FIG. 3, the liquid-conducting device 9 is designed as a direct part of the structure of the pumping station 1 where it is part of the concrete construction. Lowered into it is a pump 5 which is designed as a submersible motor-driven pump and whose drive motor has the liquid being delivered washing around it. A design of this type can be fitted very easily and can easily be lifted out for possible maintenance purposes. The driving energy required is introduced by electric supply cables 20. The principle of operation is the same as for the embodiment of FIG. 1. In addition, a vacuum system 21 for eliminating air from the discharge chamber 3 is provided. It enables the pumping station 1 to be started up, in special cases, and can open into the installation opening 8.1, be combined with the ventilating means 15 or arranged in another manner.

For maintenance work in the region of the inlet and discharge 2, 11 and in the region of the pump 5 having the associated drive unit 6, the illustrative pumping station embodiments shown in the drawings may also use hoists with which work of this type is facilitated. The inlet chamber 2 is designed here so that it is partially covered, since it has a covered inlet compartment 2.1 from which the pump 5 draws in its intake. At low liquid levels, the formation of disadvantageous, air-trapping eddies is therefore avoided.

Figure 4:
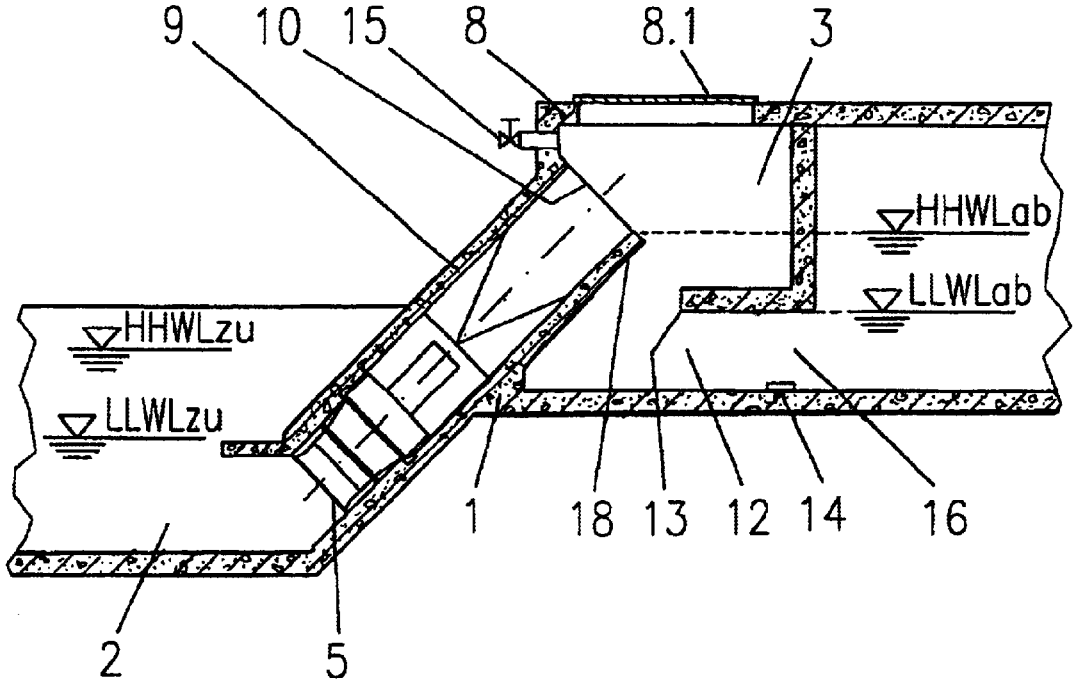
FIG. 4 shows a pumping station having an obliquely arranged pump.

FIG. 4 shows an embodiment of a pumping station 1 having an obliquely arranged pump 5. In order to realize a saving on costs for the structure of the pumping station, a submersible motor-pump unit is fitted into the obliquely running, liquid-conducting device 9. Pumps 5 of this type, which are also known as submersible motor-driven pumps, have a continuously submerged and very low-maintenance motor. The outlet opening 10 of the liquid-conducting device 9 can, as shown, extend obliquely with respect to the levels present in the pumping station. The oblique position selected is dependent on the local circumstances at the installation site. Situated in the cover 8 of the discharge chamber 3 is an installation opening 8.1, which can be closed in an air-tight manner, for the installation, inspection and the like of the pump arranged lowered into the inlet chamber 2. Even in such a design of a pumping station 1, a delivered flow measuring device having associated sensors 14 can be used in a measuring channel 16.

The liquid-conducting device 9 has, in the region of the pump 5 which is lowered into it, a round cross section which merges into an angular cross section in the direction of outlet opening 10. In the case of those structural components which are formed as a concrete construction, the angular cross sections which are used reduce the production costs and lower the operating costs of the pumping station, since there is the simple option as a result of using relatively large cross-sectional surfaces through which the flow passes. The lower edge 18 of the outlet opening 10 is arranged at least at the level of the level HHLWout. Such a design of a pumping station can be produced very compactly and is accessible. A pump 5 can therefore be lowered onto the installation site directly from a motor vehicle delivering it. In this compact design of a pumping station, the function of the partition 4 is taken over by the liquid-conducting device 9.

Figure 5:
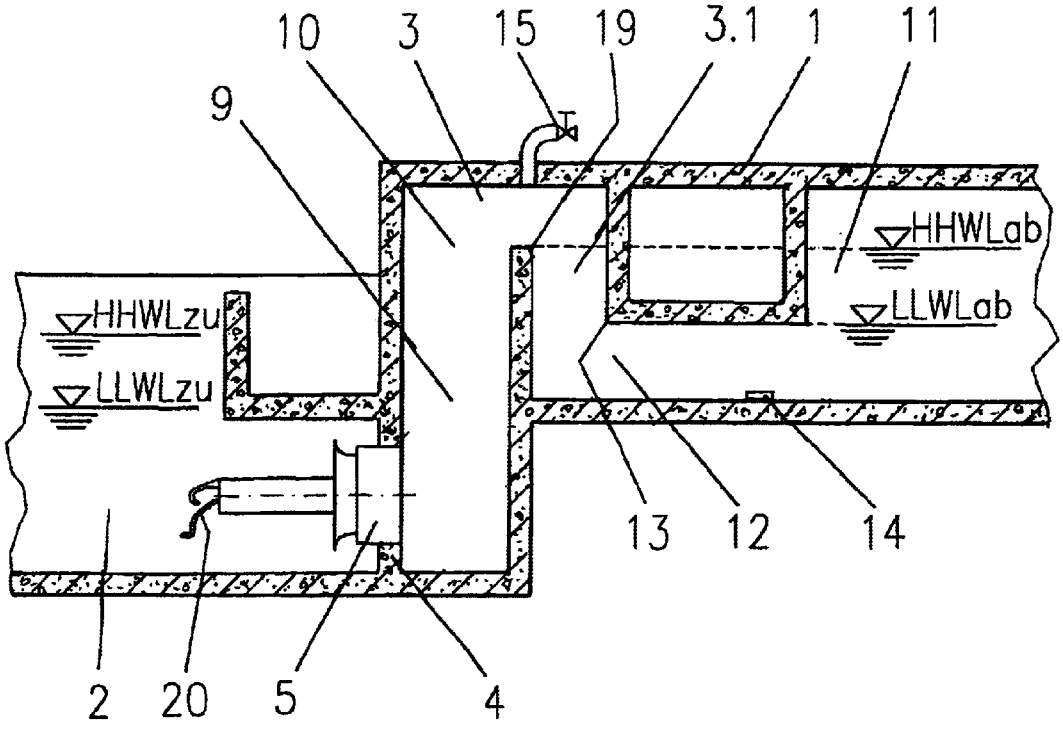
FIG. 5 shows a pumping station having a horizontally arranged pump.

FIG. 5 shows a pumping station 1 having a horizontally arranged pump 5 and likewise in a compact design similarly to FIG. 4. The pump 5 can be a single- or multi-stage submerged motor-driven pump. The partition 4 between the inlet chamber 2 and discharge chamber 3 is arranged vertically. The pump 5 delivers directly into a liquid-conducting device 9 which is of a shaft-like design and from there into the discharge chamber 3. In that chamber part 3.1 of the discharge chamber 3, which part is situated in the direction of flow behind the outlet opening 10 of the liquid-conducting device 9, the upper edge 13 of the discharge opening 12 is arranged at a relatively low height. The outlet opening 10 is arranged here at least at the same height as the highest attainable high water level HHWLout on the discharge side 11. Therefore, only the pump delivery head required for the particular level is necessary for changing operating water levels (for example LLWL) in the discharge channel.

In the schematic illustrations of the illustrative embodiments of FIGS. 1 to 5, the transitions in the structures between the different flow paths are illustrated in a simplified manner having sharp-edge transitions. In the case of systems implemented in practice, the flow paths are, of course, optimized in order to reduce the resistances. The cross sections of the flow paths are of extremely large dimensions on account of the design of the pumping station. The transitions are designed in accordance with the flow quantities flowing through them. In contrast to the known designs, in which a siphon system is formed by flow-conducting piping, the overall efficiency of a pumping station 1 can be significantly increased by measures of this type. Integrating a siphon in this manner directly into the structure of the pumping station simplifies the design thereof to a quite substantial extent.

The foregoing description and examples have been set forth merely to illustrate the invention and are not intended to be limiting. Since modifications of the described embodiments incorporating the spirit and substance of the invention may occur to persons skilled in the art, the invention should be construed broadly to include all variations falling within the scope of the appended claims and equivalents thereof.

What is claimed is:

1. A pumping station comprising a structure which includes at least one inlet chamber and at least one discharge chamber for a liquid which is to be conveyed, said discharge chamber being arranged at a different height from said inlet chamber, a separating wall within the structure between the inlet and discharge chambers, and at least one pump for delivering a liquid through the separating wall into the discharge chamber, the discharge chamber having a discharge opening which is arranged at an angle to an open outlet opening of the pump, said discharge opening having an upper edge situated below a liquid level which prevails in a discharge arranged downstream of the structure, wherein the pump is provided with an upwardly directed, liquid-conducting device leading to the pump outlet opening, and said outlet opening is arranged in the discharge chamber above the upper edge of the discharge opening.

2. A pumping station according to claim 1, wherein the liquid-conducting device is constructed as an upwardly directed pipe or a rising channel.

3. A pumping station according to claim 1, wherein the upper edge of the discharge opening is part of an adjustable opening, whereby the height of said upper edge can be varied.

4. A pumping station according to claim 1, further comprising a flow measuring device arranged in the liquid-conducting device or in the vicinity of the discharge opening.

5. A pumping station according to claim 4, wherein said discharge chamber communicates through said discharge opening with a substantially horizontal discharge channel, and the flow measuring device is arranged in said discharge channel downstream of the discharge opening.

6. A pumping station according to claim 4, wherein the flow measuring device transmits a measured flow signal to a remote monitoring location for the pumping station.

7. A pumping station according to claim 4, wherein the flow measuring device is arranged in a cross-sectional area of the structure through which the conveyed liquid passes, and the structure is configured so that said cross-sectional area is completely filled with conveyed liquid.

8. A pumping station according to claim 1, wherein the pump is equipped with fixed impeller vanes or guide vanes.

9. A pumping station according to claim 1, wherein the pump is equipped with adjustable impeller vanes or guide vanes.

10. A pumping station according to claim 1, wherein the open outlet of the liquid-conducting device has a lowest edge which is level with or higher than a maximum liquid level which arises in said discharge.

11. A pumping station according to claim 10, wherein the liquid-conducting device extends vertically.

12. A pumping station according to claim 10, wherein the liquid-conducting device has an inclined orientation.

13. A pumping station according to claim 1, wherein the discharge chamber is provided with a venting device.

14. A pumping station according to claim 1, wherein said pump is driven by a drive unit arranged in a dry location above the discharge chamber, and the drive unit is connected to the pump by a shaft which extends through a seal-less shaft passage into the discharge chamber.

15. A pumping station according to claim 1, further comprising a vacuum system connected to said discharge chamber for drawing a vacuum in said discharge chamber to assist in start-up of the pumping station.

16. A pumping station according to claim 4, wherein the flow measuring device is disposed in a measuring channel in the form of a sump arranged downstream of the discharge chamber.

17. A pumping station according to claim 1, wherein said structure has wall geometries which facilitate changes in liquid flow direction in an energy saving manner.

* * * * *